United States Patent [19]

Chaffee et al.

[11] 4,203,720

[45] May 20, 1980

[54] OIL BURNER

[75] Inventors: Robert C. Chaffee, Green; Ernest G. Bauer, Clay Center, both of Kans.

[73] Assignee: Gilmore & Tatge Mfg. Co., Clay Center, Kans.

[21] Appl. No.: 892,286

[22] Filed: Mar. 31, 1978

[51] Int. Cl.[2] ..... F24H 3/02

[52] U.S. Cl. ..... 432/222; 126/110 C; 431/90; 431/353

[58] Field of Search ..... 432/222; 431/351, 352, 431/353, 9, 71, 90; 126/110 C

[56] References Cited

U.S. PATENT DOCUMENTS

| | | | |
|---|---|---|---|
| 2,330,190 | 9/1943 | Beckett | 431/9 |
| 3,030,773 | 4/1962 | Johnson | 431/9 X |
| 3,256,003 | 6/1966 | Briggs | 432/222 X |
| 3,561,740 | 2/1971 | Walker | 432/222 |
| 4,054,028 | 10/1977 | Kawaguchi | 431/353 |

*Primary Examiner*—Edward G. Favors
*Attorney, Agent, or Firm*—John A. Hamilton

[57] ABSTRACT

An oil burner for distillate fuel including a blower and air guiding elements producing a rapidly whirling pattern of combustion air close to the burner nozzles to produce an extremely hot fireball close to the nozzles. The fireball, once ignited, provides reliable continuous ignition of the entering fuel, obviating the usual requirement of continuous electrical ignition, and permitting the use of low voltage for the initial ignition. The blower produces an excess of air over that needed for combustion, and the excess air cools the combustion chamber externally to obviate any necessity of forming the chamber of stainless steel, cast iron or the like. When the burner includes a plurality of burner nozzles intended for use singly or simultaneously, automatic means are provided for supplying the necessary carefully regulated amounts of combustion air.

6 Claims, 7 Drawing Figures

OIL BURNER

Figure 1:
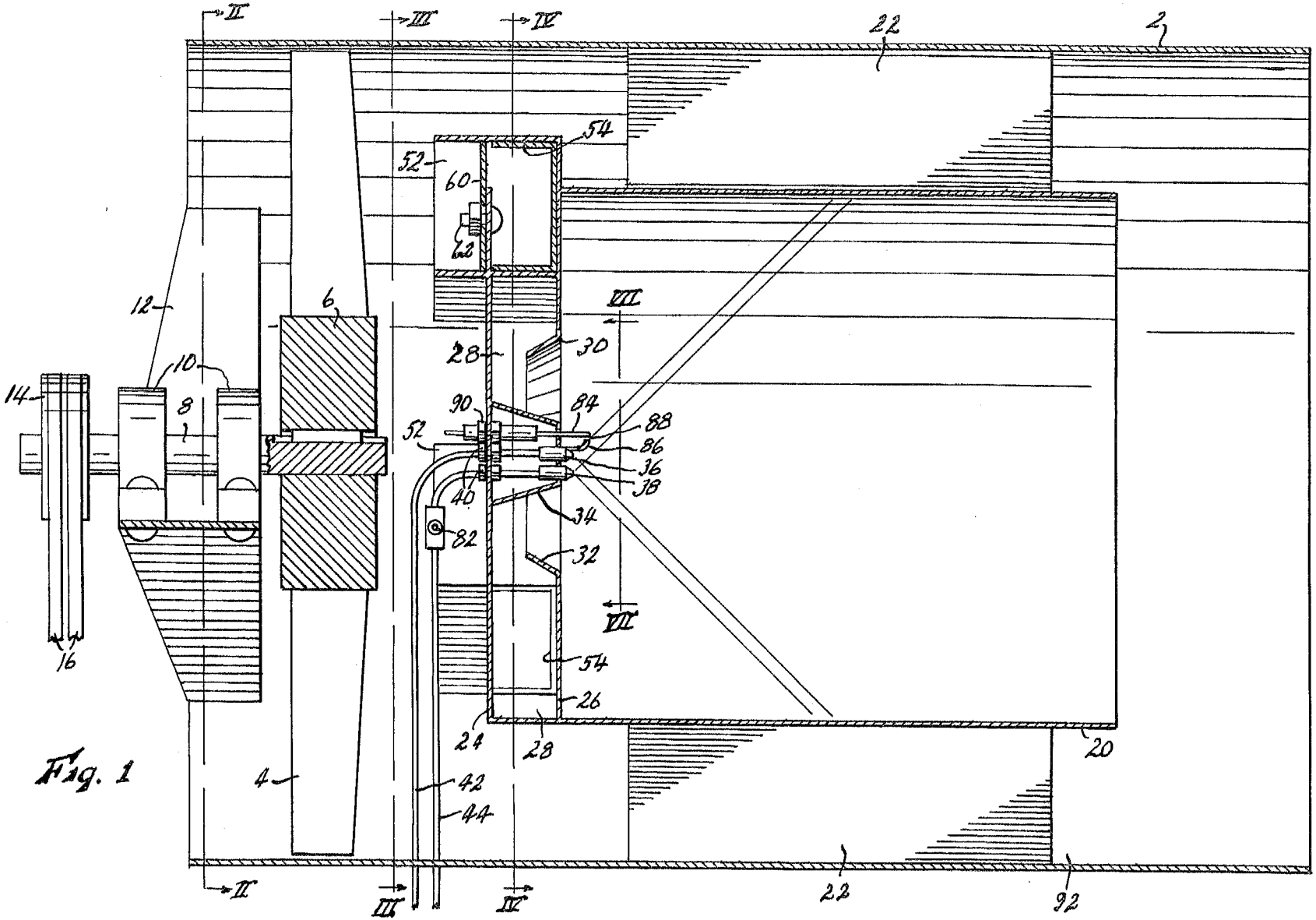

This invention relates to new and useful improvements in oil burners, and as shown, relates more specifically to an oil burner-powered heater for producing large quantities of heated air for use in drying previously harvested grain or the like, although as will be apparent its usage is not limited to this purpose.

In the usual oil burner, the fuel is sprayed into a combustion chamber by one or more nozzles supplied with fuel from a pressurized source, combustion air is introduced into the chamber moving generally parallel to the nozzles, and the air-fuel mixture ignited by an electric spark producing means disposed forwardly of the nozzles. Disadvantages of such burners include the fact that they have required the use of a continuous spark for reliable ignition of the fuel, particularly when a distillate or diesel fuel of relatively low volatility is used, since the flame may, due to the high discharge velocity of the nozzles, be snuffed out at any time even after it has been initially ignited. The ignition spark used must also be of high intensity, usually requiring the use of a 110 volt ignition circuit, in order to maintain a reliable sparking action within the high velocity blast of unignited fuel and air to which it is sometimes subjected. Also, the combustion chamber is usually completely filled with flame, subjecting its walls to the damage and deterioration resulting from extremely high temperature and direct contact with the flame. The provision of an oil burner overcoming all of these disadvantages of prior burners is the overall object of the present invention.

More specifically, one object of the present invention is the provision of an oil burner in which the oil is injected by a nozzle axially into one end of an elongated combustion chamber, and combustion air is introduced into the same end of the chamber by means producing a pattern of rapidly whirling air coaxial with and spaced forwardly of the nozzle. This tends to retain the air and oil close to the nozzle for a longer period of time, producing extremely thorough intermixture of the air and oil, and when ignited producing an extremely hot "fireball" close to the nozzle. The fireball reliably ignites subsequently injected fuel, so that continuous ignition is not required, but only ignition at the moment of starting the burner in operation. So long as the ignition spark is established just before the oil is injected, it can ignite the "leading edge" of the oil when the oil is then injected, before the full velocity of the air-oil blast is established. At this time, a low intensity spark, operable for example by a 12 volt circuit, is ample to provide initial ignition, and thereafter ignition is maintained by the "fireball" already mentioned.

Another object is the provision of an oil burner of the character described wherein the combustion air is supplied by a blower having a capacity much larger than required for complete combustion of the oil, and means for circulating the excess air over the exterior surfaces of the combustion chamber. This cools the combustion chamber walls, permitting them to be formed of ordinary sheet steel rather than the stainless steel or cast metals usually required. The air thus circulated is of course also heated, and is an end product of the burner if said burner is functioning as an air heater.

The type of air injection described above requires careful regulation of not only the manner of injection of the air, but also of the volume of the air injected. Many burners include two fuel nozzles, one intended for continuous use and the other for use only in periods of peak demand, so that it operates intermittently. Accordingly, a further object of the present invention is the provision of automatic means for regulating the quantity of air delivered to the combustion chamber whenever the intermittent burner nozzle is activated or deactivated.

Other objects are simplicity and economy of construction, and efficiency and dependability of operation.

Figure 2:
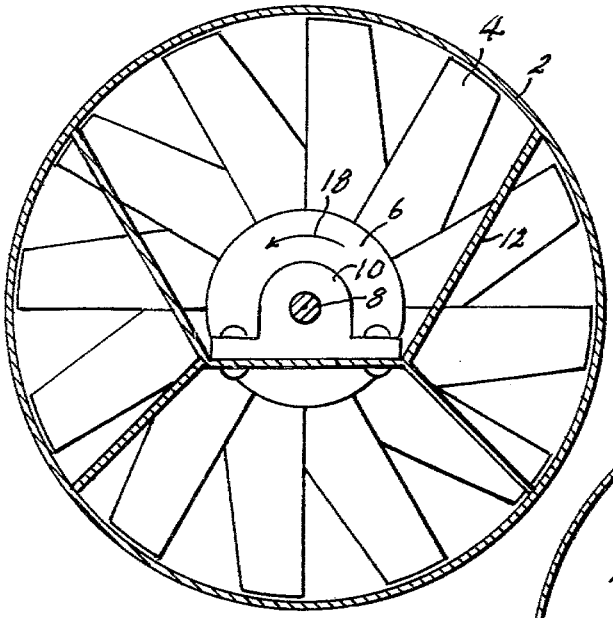
Figure 7:
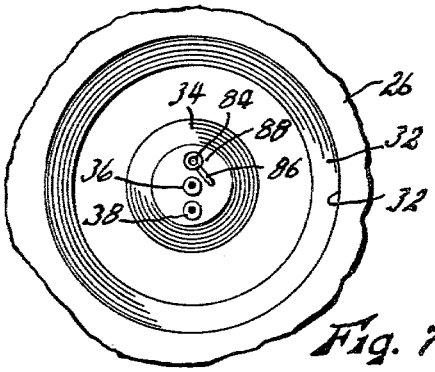
Figure 3:
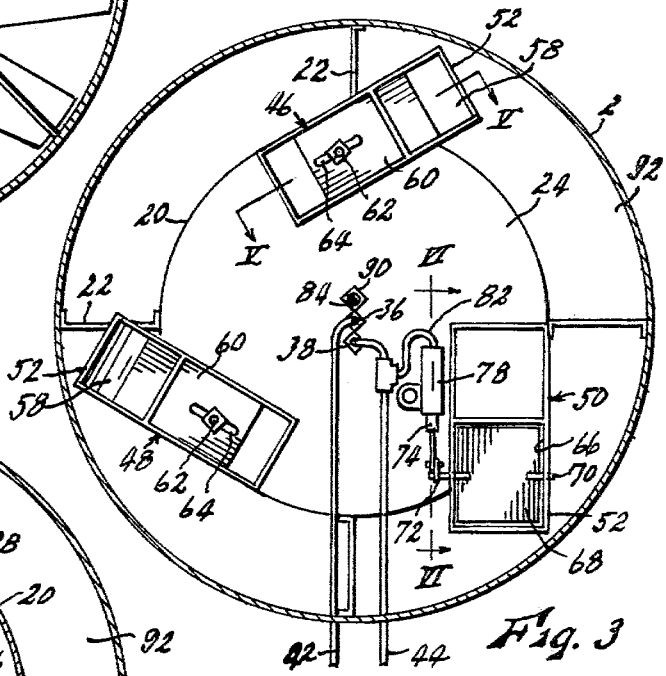
Figure 4:
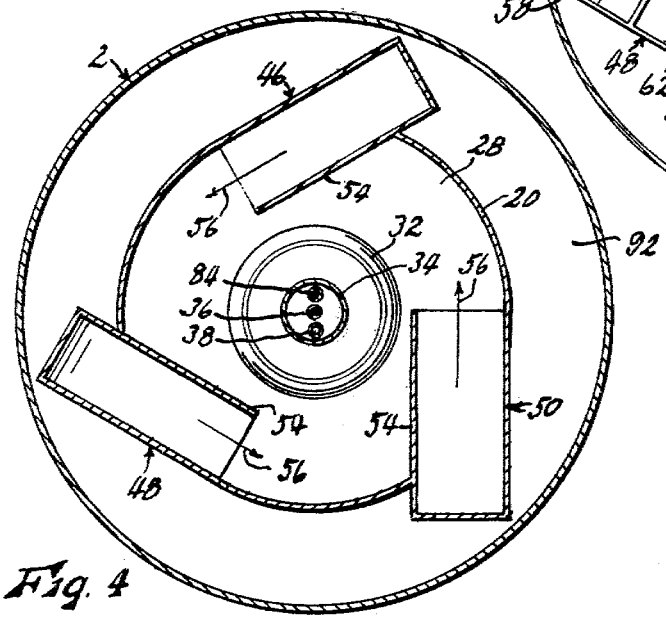
Figure 5:
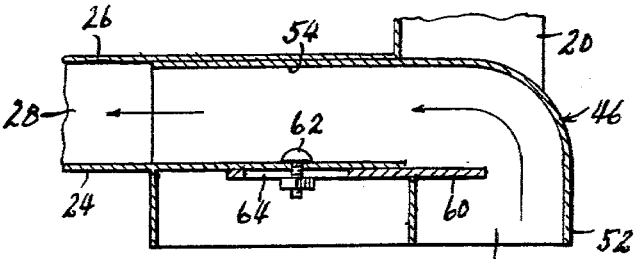
Figure 6:
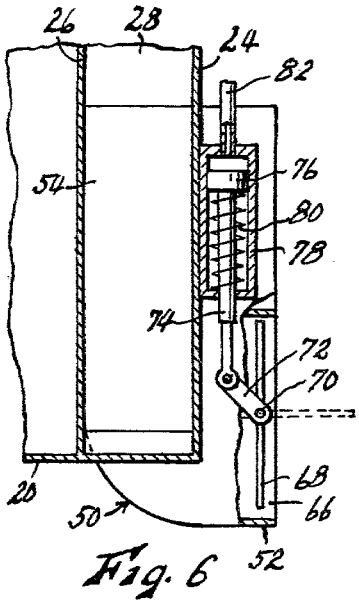

With these objects in view, as well as other objects which will appear in the course of the specification, reference will be had to the accompanying drawing, wherein:

FIG. 1 is a slightly irregular vertical longitudinal section of an oil burner embodying the present invention, FIG. 2 is a reduced sectional view taken on line II—II of FIG. 1, FIG. 3 is a reduced sectional view taken on line III—III of FIG. 1, FIG. 4 is a reduced, slightly irregular sectional view taken on line IV—IV of FIG. 1, FIG. 5 is an enlarged, fragmentary sectional view taken on line V—V of FIG. 3, FIG. 6 is an enlarged, fragmentary sectional view taken on line VI—VI of FIG. 3, and FIG. 7 is a fragmentary view taken on line VII—VII of FIG. 1.

Like reference numerals apply to similar parts throughout the several views, and the numeral 2 applies to the barrel or outer housing of an oil burner as contemplated by the present invention. Said barrel is formed of sheet metal, is cylindrical about a horizontal axis, and is open at both ends. It may be supported by any suitable means, not shown. In its rearward end portion is mounted a blower fan 4 which is rotatable coaxially with the barrel, and is operable to direct air forwardly through the barrel. The hub 6 of the fan is fixed on a shaft 8 coaxial with the barrel, and journalled in bearings 10 mounted on a spider 12 fixed in the barrel. Shaft 8 projects rearwardly of the barrel, and has a pulley wheel 14 affixed to its rearward end which is connected by drive belts 16 to an engine or any other suitable driving means, not shown, whereby fan 4 is turned in the direction of arrow 18 in FIG. 2.

Mounted in barrel 2, forwardly of fan 4 and coaxially with the barrel, is a cylindrical combustion chamber 20. Said combustion chamber is open at its forward end, and is fixed in the barrel by radial webs 22 extending therebetween and affixed thereto. The rearward end of the combustion chamber is closed by a circular end plate 24 rigidly affixed therein. A circular plate 26 parallel to plate 24 is affixed around its periphery in the combustion chamber forwardly of plate 24, whereby an air chest 28 is formed between walls 24 and 26. Plate 26 has a central circular aperture 30 formed therein, from the periphery of which a frustro-conical, rearwardly convergent baffle ring 32 extends, terminating in forwardly spaced relation from plate 24. A forwardly convergent frustro-conical baffle 34 is affixed centrally to plate 24, being of smaller diameter than baffle ring 32 and extending forwardly to a position substantially flush with plate 26, as best shown in FIG. 1.

A pair of oil burner nozzles 36 and 38 are affixed in plate 24, as indicated at 40, project forwardly through baffle 34 and through apertures provided therefor in the forward end wall of baffle 24, into the rearward end of combustion chamber 20, substantially axially of said chamber although slightly spaced apart. Nozzle 36 operates continuously as long as the burner is operating, while nozzle 38 operates only during periods of peak demand. The nozzles are supplied with fuel from a suitable pressurized source, not shown, by pipes 42 and 44 respectively.

A plurality of angled air chutes 46, 48 and 50 are sealed in end plate 24 at regularly spaced angular intervals about the periphery thereof. Each chute has an entry leg 52 extending somewhat rearwardly of plate 24, but still spaced forwardly of fan 4, to receive air thereinto directly from said fan, and a right-angled exit leg 54 extending tangentially into air chest 28 between plates 24 and 26, so that air is delivered into said air chest with a strong whirling motion in the direction of arrows 56 in FIG. 4. The entry throat 58 of each of chutes 46 and 48 (see FIGS. 3 and 5) is regulated by a damper door 60 secured to plate 24 by a screw 62 engaged in an elongated slot 64 of the damper door, whereby by loosening said screw, the extent to which said door covers throat 58, and hence the quantity of air admitted, may be varied.

The entry throat 66 of air chute 50 is controlled by a damper door 68 pivoted therein at 70 for movement between a closed position as shown in solid lines in FIG. 6, and an open position as shown in dotted lines. Fixed on the extended pivot pin 70 of door 68 is a short crank 72 to the free end of which is pivoted the piston rod 74 of a piston 76 operably mounted in a hydraulic cylinder 78 mounted on plate 24. A spring 80 biases the piston 76 in a direction to close damper door 68. The opposite end of cylinder 78 is connected by a pipe 82 into fuel pipe 44 ahead of intermittent burner nozzle 38. Hence whenever pressurized fuel is delivered to nozzle 38, the pressure is also delivered to cylinder 78 through pipe 82 to move piston 76 against spring 80 to open damper door 68. Nozzles 36 and 38 are operable to direct generally conical sprays of oil into the combustion chamber, as indicated in FIG. 1. A pair of electrodes 84 and 86 provide a spark gap 88 which is adjacent the nozzles and in the fringe zones of the spray cones thereof. Electrode 84 is fixed in plate 24, as at 90, and extends forwardly through baffle cone 34. Electrode 86 is affixed directly to cone 34 as a ground. The lead wires of a spark coil or the like may be attached to electrode 84 and to ground to provide electric current causing a spark to pass through gap 88.

In operation, the burner is set in operation by initiating a spark at spark gap 88, delivering oil under pressure to nozzle 36, and starting fan 4 to deliver air, preferably in that order. As long as the spark is initiated before the air and oil flow is started, it can ignite the very first, or "leading edge" of the oil as it starts from the nozzle, before the full velocity of the oil and air blast has been established. Thus the burner can be ignited by a low intensity spark, such for example as may be powered from a 12 volt battery source, rather than requiring a high intensity spark necessitating 110 volt line current, as required by present oil burners of comparable types. This is a great advantage when the burner is to be used in the field where 110 volt sources are rare, since 12 volt batteries are easily portable. If the full velocity of the air and oil blast is allowed to develop before the spark is initiated, difficulty is experienced in obtaining reliable ignition with a low intensity spark, due to the comparatively low volatility of the oil fuels often used, causing relatively slow ignition thereof. In fact, the usual burner requires not only a high intensity spark, but also a continuous sparking as long as the burner is operating, since the flame may blow or snuff itself out at any time, for the same reasons. The method and pattern of air supply prevents this occurrence in the present burner, as will presently be described. Nozzle 36 normally operates continuously as long as the burner is operative, while nozzle 38 operates only during periods of peak demand, as dictated by controls of thermostatic or other types, not shown.

As will be readily apparent, operation of both nozzles simultaneously requires a greater quantity of air to be delivered to the combustion chamber than when only nozzle 36 is operating. In the present structure, the delivery of fuel to intermittent nozzle 38 opens damper door 68 to admit additional air to the combustion chamber, while cessation of oil supply to nozzle 38 allows spring 80 to close the damper. The flow capacities of damper 68 and the two adjustable dampers 60 are of course regulated to the fuel consumption rates of the nozzles.

Fan 4 has an air delivery capacity greatly in excess of the air volume required for full combustion of the oil, even when both nozzles are operating. Of the total air delivered by the fan, a portion thereof ample for full combustion is received into the open rearward ends of air chutes 46 and 48, and also chute 50 when nozzle 38 is operative, and is delivered by said chutes tangentially into air chest 28 to create a counter-clockwise whirling motion of the air in said air chest, as indicated in FIG. 4. This whirling motion is increased in speed within the air chest before the air can escape forwardly into the combustion chamber through aperture 30 of plate 26, due to the restricted diameter of said aperture, so that the air enters the combustion chamber with a rapidly whirling motion. This whirling motion continues within the combustion chamber, since the air is still confined by the combustion chamber against outward centrifugal motion, and is an extremely important feature of the present invention. It retains the air-oil mixture within the rearward portion of the combustion chamber for a considerably longer time period than would be the case if the whirling motion were not employed, and during this time the combustion of the oil advances substantially and may even be substantially completed. This establishes an extremely hot "fireball" within the rearward portion of the combustion chamber, into which the oil injected by the nozzles is received. The fireball provides fully reliable ignition of the oil, so that a spark need not be maintained continuously at gap 88, but only momentarily to start the burner in operation. Combustion of the oil in the fireball is so complete that actual flame almost never reaches the open forward end of the combustion chamber, except perhaps at the highest rates of fuel consumption, and there is never the long tongue of flame emerging from the forward end of the chamber such as is characeristic of many prior burners.

Of course, the relatively localized oil combustion just described as occurring in a "fireball" in the rearward portion of the combustion chamber tends to heat the chamber walls to a very high temperature. Even in burners not utilizing the fireball principle, the combustion chamber walls must ordinarily be formed of stainless steel, heavy cast iron, or other relatively expensive material to protect them from heat and flame damage. In the present burner, however, the combustion chamber walls are cooled by the large excess of air delivered by fan 4 over that required for combustion of the oil. The combustion air is collected and delivered to the combustion chamber by air chutes 46, 48 and 50, while the excess passes through the annular passage 92 between the combustion chamber and barrel 2, wherein it cools the combustion chamber, and is itself heated. The heating of this air is of course useful where the primary purpose of the burner is the production of large quantities of hot air, to be used for example to dry moist grain, but insofar as the operation of the burner itself is concerned, the primary function of the air passing through passage 92 is the cooling of the combustion chamber. It has been found quite practical to pass sufficient air through this passage to maintain the wall of chamber 20 sufficiently cool that it may be formed of ordinary sheet steel and still not be subject to heat or flame damage even in long periods of burner operation. In fact, although the reason therefor is not fully understood, careful observation has shown that the flame within the combustion chamber seldom if ever actually contacts the walls, but remains spaced apart therefrom. It is believed that this effect results perhaps from the fact that the wall is actually maintained so cool by the air passing over its outer surface that any flame tending to approach its inner surface is snuffed out. Regardless of the cause, however, it does provide further protection for the walls, since direct flame contact is one cause of wall damage.

The described separation of the flame from the combustion chamber wall of course requires that the flame be well "centered" in the chamber, which in turn requires that the air enter the chamber evenly and uniformly around the periphery of aperture 30 of plate 26. It has been found almost impossible to obtain this even air flow around the periphery of aperture 30 without using conical baffle ring 32, especially when air chutes 46 and 48 are operative but chute 50 is not, due to closure of damper door 68. Even when door 68 is open, it usually delivers a disproportionately large quantity of air as compared to either of the other chutes, so that the delivery of air to air chest 28 is still peripherally unbalanced. However, with baffles 32 and 34, air delivery to the combustion chamber remains peripherally balanced, and the combustion chamber flame is maintained well-centered, even when only one of chutes 46, 48 and 50 is actually delivering air.

While we have shown and described a specific embodiment of our invention, it will be readily apparent that many minor changes of structure and operation could be made without departing from the spirit of the invention.

What we claim as new and desire to protect by Letters Patent is:

1. An oil burner comprising:

a. an elongated combustion chamber open at its forward end, b. a nozzle mounted at the rearward end of said combustion chamber and operable to spray oil longitudinally forwardly in said chamber, c. means operable to ignite said oil initially, and d. air delivery means operable to direct combustion air into the rearward end of said combustion chamber in a whirling pattern generally coaxial with said nozzle, whereby the air-oil mixture tends to be retained in the rearward portion of said combustion chamber and a hot fireball of flame develops therein, said fireball serving reliably to ignite oil subsequently ejected from said nozzle to render continuous ignition unnecessary, said air delivery means comprising a circular air chest disposed at the rearward end of said combustion chamber coaxially therewith, said chest having a forward wall dividing it from said combustion chamber and having a circular aperture of lesser diameter formed centrally therein coaxial with said combustion chamber, and a rearward wall, said nozzle being mounted in said rearward wall and projecting forwardly through said aperture, and blower means operable to deliver air tangentially into said air chest.

2. An oil burner as recited in claim 1 with the addition of a forwardly tapering frustro-conical baffle fixed to the rearward end wall of said air chest and projecting forwardly into the aperture of its forward wall concentrically therewith, being of smaller diameter than said aperture, said nozzle projecting through said baffle to a point just forwardly thereof, and a frustro-conical baffle ring affixed peripherally in said aperture, and converging rearwardly to a plane spaced forwardly from the rearward wall of said air chest.

3. An oil burner as recited in claim 1 including a plurality of right-angled air chutes each having a leg opening tangentially into said air chest and a leg opening rearwardly from said air chest, said blower means being operable to deliver air forwardly into the rearwardly opening legs of said chutes.

4. An oil burner as recited in claim 3 with the addition of:

a. at least one additional oil nozzle operable to spray oil into said combustion chamber.

b. a damper door operable selectively to open or close at least one of said air chutes, the remaining chutes being of sufficient capacity to supply combustion air to the first of said nozzles, c. means yieldably biasing said damper door closed, and d. operating means responsive to the actuation of said additional nozzle to open said damper door, whereby to supply additional combustion air for said additional nozzle.

5. An oil burner as recited in claim 4 wherein oil is supplied to said nozzles under pressure, and wherein said operating means comprises a pressure-responsive device operable by the pressure of oil supplied to said additional nozzle to open said damper door.

6. An oil burner as recited in claim 3 wherein said combustion chamber is formed of a thin, heat-conductive material, and with the addition of a barrel concentrically surrounding said combustion chamber to form an annular air passage therebetween, extending rearwardly of said combustion chamber, air chest and chutes, and being open at both ends, and wherein said blower means comprises a power driven fan mounted within said barrel rearwardly of said chutes and operable to direct air forwardly over substantially the entire area of said barrel, a portion of said air thus entering said chutes for combustion purposes, and the remainder of said air passing forwardly through said annular passage to cool the exterior surface of said combustion chamber, and to be heated thereby.

* * * * *